US007143922B2

(12) United States Patent
Shevin-Sandy

(10) Patent No.: US 7,143,922 B2
(45) Date of Patent: Dec. 5, 2006

(54) STAPLER WITH TAPE DISPENSER AND FLAG DISPENSER

(75) Inventor: Bonni Shevin-Sandy, Morton Grove, IL (US)

(73) Assignee: Dard Products, Inc., Evanston, IL (US)

( * ) Notice: Subject to any disclaimer, the term of this patent is extended or adjusted under 35 U.S.C. 154(b) by 0 days.

(21) Appl. No.: 11/014,397

(22) Filed: Dec. 14, 2004

(65) Prior Publication Data

US 2006/0026769 A1 Feb. 9, 2006

Related U.S. Application Data

(60) Provisional application No. 60/599,567, filed on Aug. 6, 2004.

(51) Int. Cl.
*B25F 1/00* (2006.01)

(52) U.S. Cl. ..... 227/156; 227/76; 227/120; 7/160

(58) Field of Classification Search ..... 227/156, 227/134, 120, 76; 221/199, 45, 46, 49; 220/780, 220/784, 796, 799; 7/160
See application file for complete search history.

(56) References Cited

U.S. PATENT DOCUMENTS 2,305,592 A * 12/1942 Anderson ..... 225/12
2,305,595 A * 12/1942 Backus ..... 464/110
4,727,610 A * 3/1988 Lin ..... 227/156
4,752,023 A * 6/1988 Lin ..... 225/26
D331,072 S * 11/1992 Dotterman et al. ..... D19/69
5,363,985 A * 11/1994 Cornell ..... 221/46
5,794,815 A * 8/1998 Carlson et al. ..... 221/45
D411,423 S * 6/1999 Huang ..... D8/50
D411,725 S * 6/1999 Matthes ..... D8/50
5,979,734 A * 11/1999 Chang ..... 227/134
6,286,745 B1 * 9/2001 Ackeret ..... 227/156
6,941,604 B1 * 9/2005 Ackeret ..... 7/160
2005/0223498 A1 * 10/2005 Kirby et al. ..... 227/63

* cited by examiner

*Primary Examiner*—John Sipos
*Assistant Examiner*—Michelle Lopez
(74) *Attorney, Agent, or Firm*—Greer, Burns & Crain, Ltd.

(57) ABSTRACT

A combination stapler, tape dispenser and flag dispenser includes a stapler having a housing including first and second arms joined together at a pivot. The first and second arms each have a distal end having a flat surface configured to permit the stapler to stand generally vertically on the flat surfaces. Also included is a tape dispenser disposed in the housing adjacent a proximal end of the first arm, and a flag dispenser disposed in the housing adjacent a proximal end of the second arm. The tape dispenser and the flag dispenser are positioned along the length of the first and second arms to outwardly oppose each other.

16 Claims, 5 Drawing Sheets

STAPLER WITH TAPE DISPENSER AND FLAG DISPENSER

RELATED APPLICATION

The present application claims priority under 35 USC§ 120 from U.S. Ser. No. 60/599,567 filed Aug. 6, 2004.

BACKGROUND OF THE INVENTION

The present invention relates generally to office products, and more specifically to staplers, tape dispensers and flag dispensers.

In today's work place, a user typically has several office supplies which he/she uses throughout the day to carry out a broad range of tasks. Ranging in size and function, office supplies are usually individually designed for one specific function. It is not unusual for a user to have multiple supplies, such as a stapler, a tape dispenser, a flag dispenser and the like, located in the immediate work space. Clutter in the work space can lead to an unpleasant work environment and reduced efficiency. Additionally, since many office supplies are smaller than other objects used in the work space, they frequently get misplaced. Further, when a user simultaneously needs more than one office supply to perform a task, the user can find himself/herself shorthanded.

Thus, there is a need for an office supply that addresses the issues and concerns described above.

SUMMARY OF THE INVENTION

The object of the present invention is to provide an office appliance that combines the functions of multiple office appliances. This objective is met by combination stapler, tape dispenser and flag dispenser which includes a stapler having a housing. Disposed in the housing is a tape dispenser, as well as a flag dispenser.

In another embodiment, an office appliance is provided including a flag dispenser disposed in a stapler for dispensing flags. The flag dispenser includes a storage bin configured to store the flags, and a cover having a slot for feeding the flags through the cover. The storage bin and the cover are removably disposed in the stapler.

In yet another embodiment, a combination stapler having a housing and a tape dispenser disposed in the housing for dispensing tape is provided. The tape dispenser includes a convex contour in the stapler housing having a concave contour for receiving a tape roll. Also included in the tape dispenser is a pin disposed in the concave contour and configured to be placed through the center of the tape roll.

DETAILED DESCRIPTION OF THE INVENTION

Figure 1:
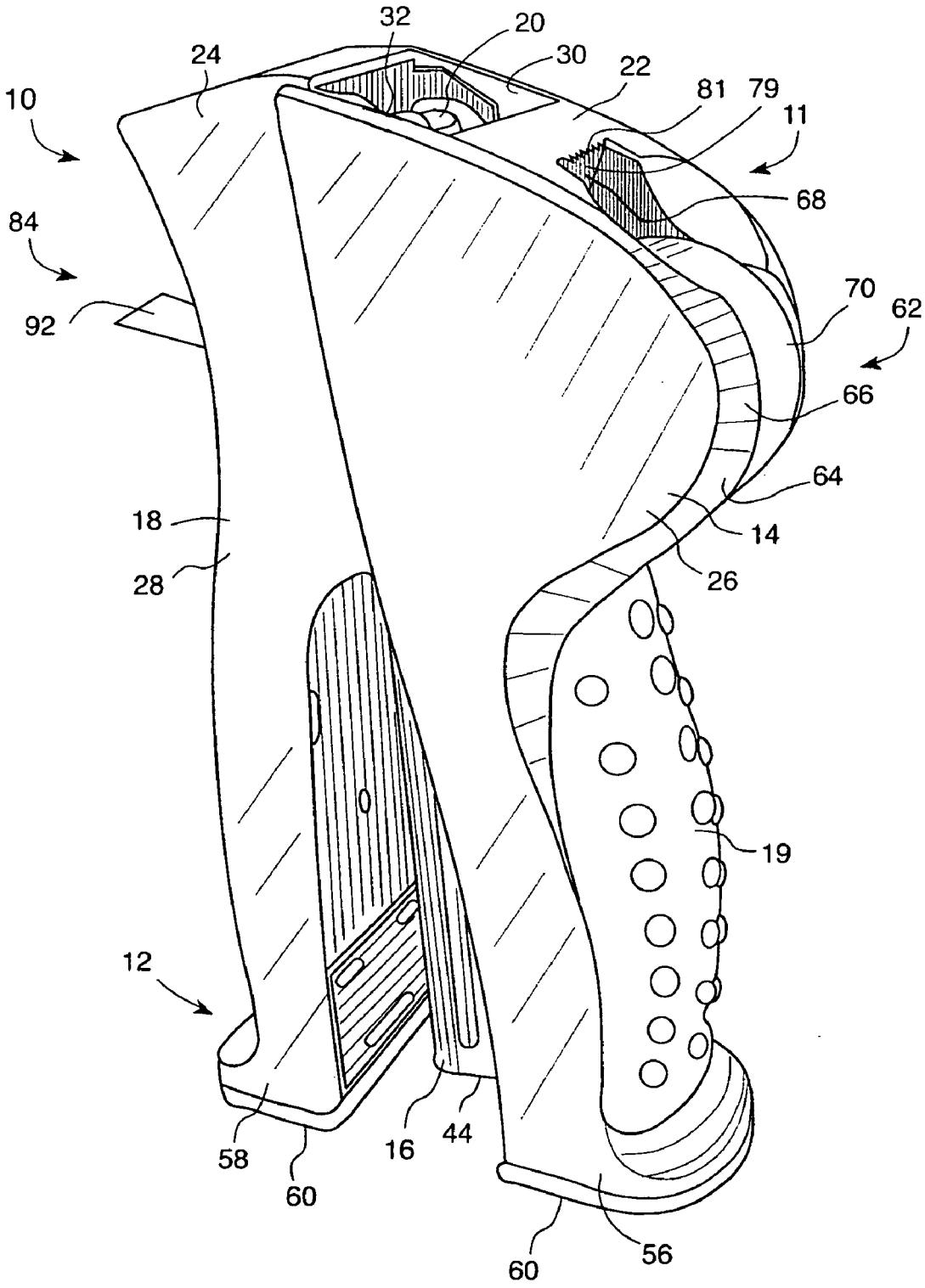
FIG. 1 is a top perspective view of the combination stapler with tape dispenser and flag dispenser.
Figure 2:
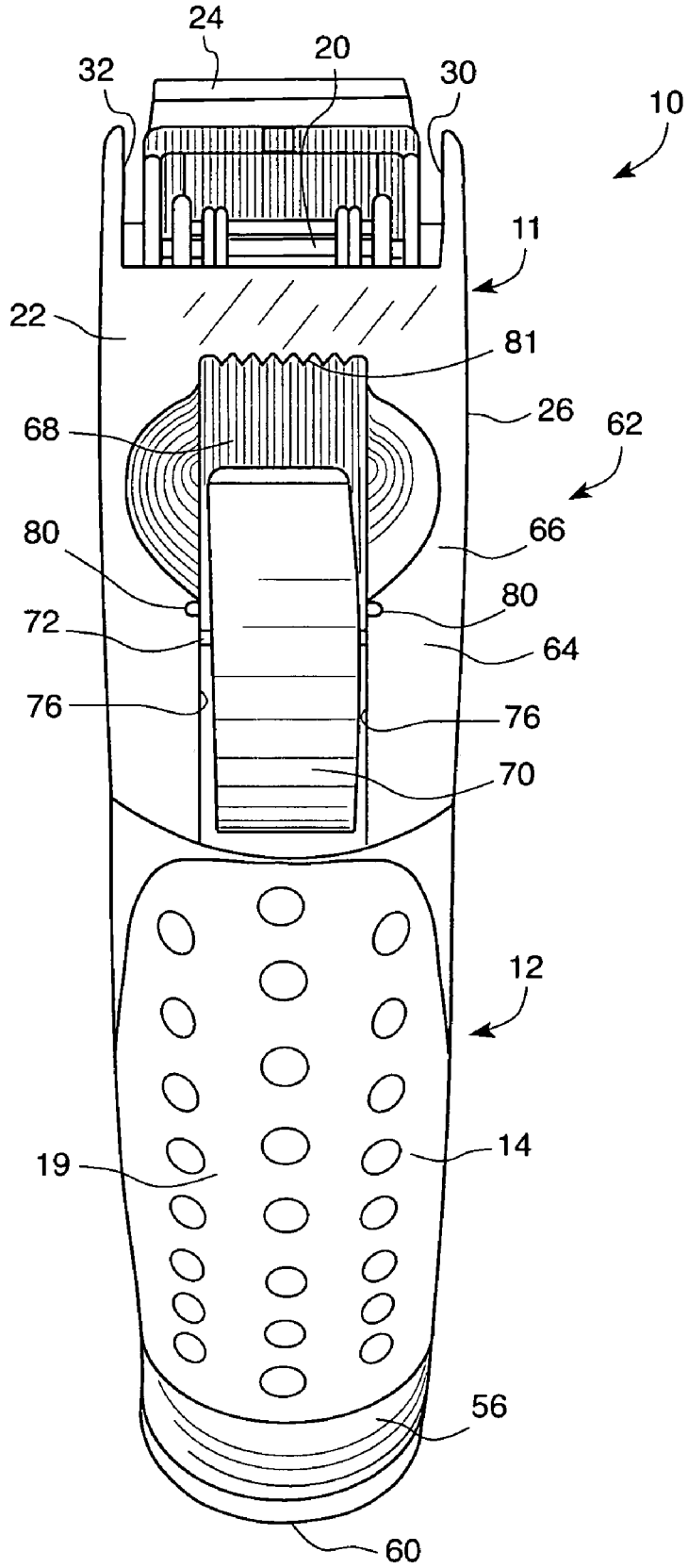
FIG. 2 is a front elevational view of the combination stapler of FIG. 1 showing the tape dispenser.
Figure 3:
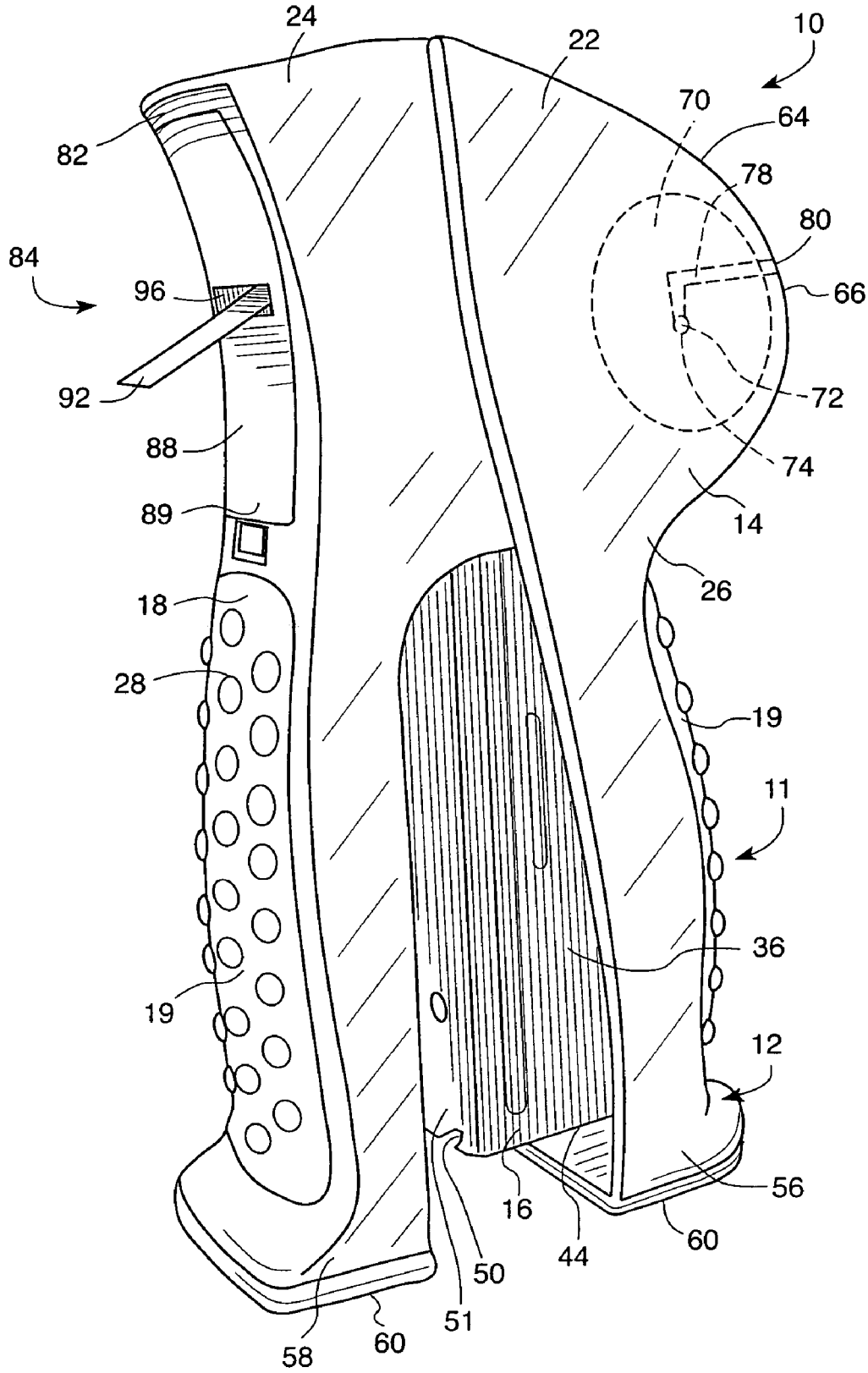
FIG. 3 is a side perspective view of the combination stapler of FIG. 1 showing the flag dispenser and the tape dispenser.

Referring to FIGS. 1–3, the present combination appliance includes a stand-up stapler, tape dispenser and flag dispenser, and is generally designated 10. For convenience of reference, the combination stand-up stapler, tape dispenser and flag dispenser 10 will hereinafter be referred to as the combination stapler 10. The combination stapler 10 incorporates multiple office tools into a single housing or housing assembly 11 while generally retaining the configuration of a conventional stapler. Further, the combination stapler 10 allows the user to replace the expendables used with the multiple office tools of the combination stapler.

The first component of the combination stapler 10 is a stapler 12 having two arms, a major arm 14 in which a dispensing mechanism 16 is disposed, and a minor arm 18, which is used to impart force against the dispensing mechanism, as is known in the art. At least one of the major and minor arms 14, 18 is preferably provided with an optional resilient grip-enhancing pad 19. The major and minor arms 14, 18 meet at a spring-loaded pivot 20 at a proximal end of each arm 22, 24, respectively. At the pivot 20, a housing 26 of the major arm 14 fits over a housing 28 of the minor arm 18, and the pivot extends through the minor arm such that the minor arm is pivotable with respect to the major arm. The pivot 20 is preferably a pin positively retained in and extending from a first inside surface 30 of the major arm housing 26 to a second inside surface 32 of the major arm housing.

Figure 5:
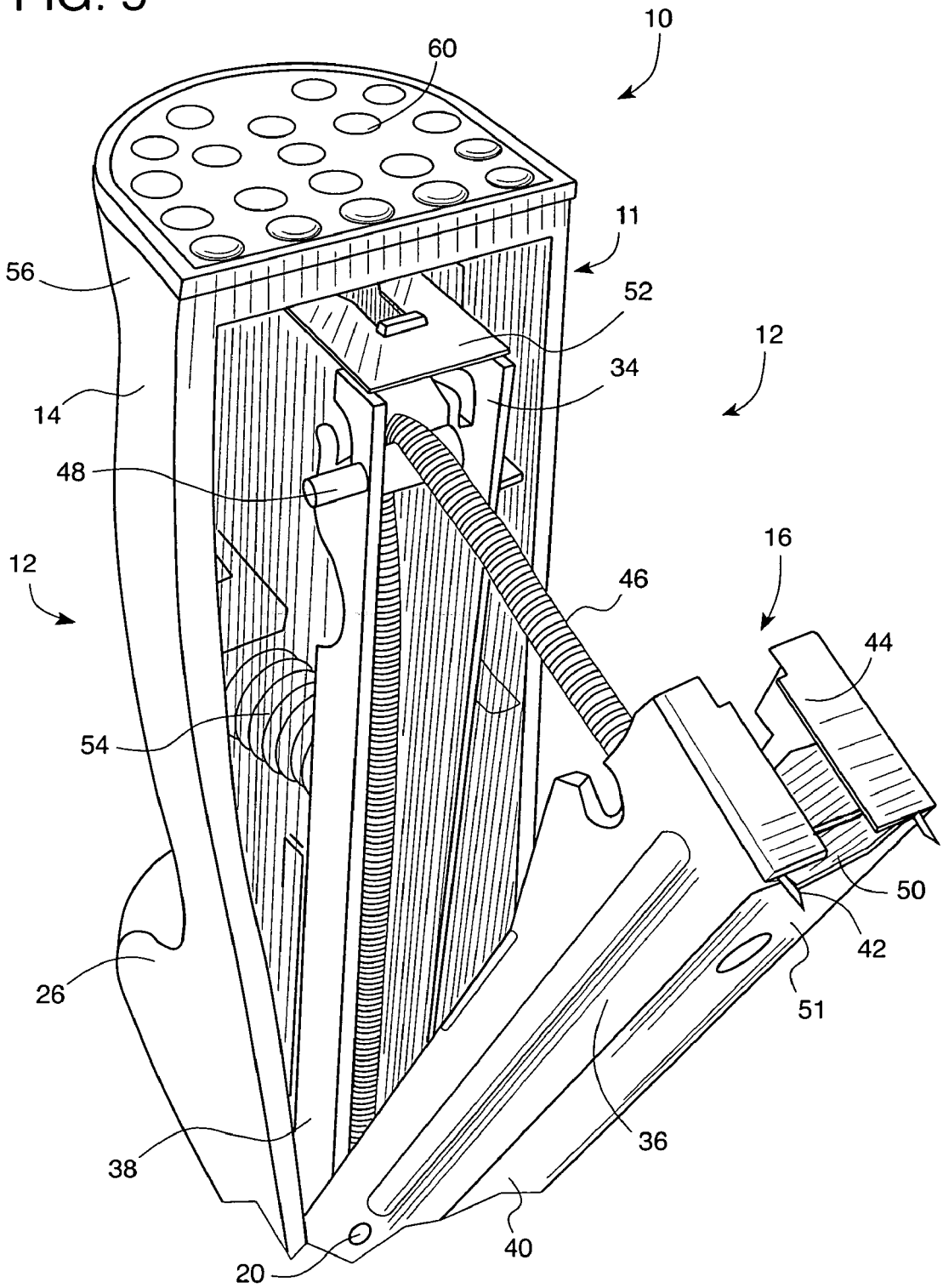
FIG. 5 is a side perspective view of a magazine member and a base member of the combination stapler of FIG. 1.

Referring now to FIG. 5, the dispensing mechanism 16 includes a base member 34 and a staple magazine member 36 pivotally secured to one another at their distal ends 38, 40, respectively, by the pivot 20. However, it is contemplated that a separate, dedicated pivot be provided to the ends 38, 40. The staple magazine member 36 is preferably a channel-like member having a general "U"-shape when viewed in section configured for receiving staples 42, as is known in the art. The base member 34 is also preferably a channel-like member having a generally inverted "U"-shape when viewed in section where spaced, generally parallel legs of the "U"-shape are preferably configured to fit within legs of the magazine member "U". In a closed position, the base member 34 is generally axially aligned with, and fits within the "U"-shape of the staple magazine member 36 to form a closed channel around the staples 42. When the magazine member 36 is opened from the base member 34, the magazine member is pivoted about the pivot 20 with respect to the base member and the major arm 14 so that staples can be placed into the magazine member.

Also included in the dispensing mechanism 16 and preferably disposed within the channel of the staple magazine member 36, a staple feeder (not shown) is preferably mounted within the legs of the "U" for sliding movement along the length of the magazine member, as is known in the art. The feeder is biased away from the pivot 20 and toward a front end 44 of the magazine member 36 by a tension spring 46. Preferably attached at the base member 34 at one end, wrapped around a base pin 48, and attached to the feeder at the other end, the tension spring 46 biases the staples 42 towards the front end 42.

A staple drive clearance 50 is formed near the front end 44 at a bottom wall 51 of the staple magazine member 36. When the staples 42 are biased towards the front end 44, a staple driver bar 52 engages and drives the staple adjacent the front end from the staple magazine member 36 into a workpiece (not shown). The staple driver bar 52 is preferably a thin member attached to the major arm 14.

The staple base member 34 is biased away from the major arm 14 by a compression spring 54 disposed between the major arm and the base member. When a user operates the stapler 12, the major arm 14 and the minor arm 18 pivot with respect to each other and towards each other. When the minor arm 18 overcomes the bias of the spring-loaded pivot 20 (FIG. 1), and engages the magazine member 36, the base member 34 disposed within the channel of the magazine member is pivoted relative to and towards the major arm 14. The pivoting of the base member 34 overcomes the bias of the compression spring 54 to move the base member and the magazine member 36 relative to the driver bar 52, which is fixed with respect to the major arm 14. The relative motion of the driver bar 52 with respect to the base member 34 and the magazine member 36 drives the staple 42 through the staple drive clearance 50 and into a workpiece (not shown).

Referring now to FIGS. 1–3, opposite the proximal ends 20, 22 of each of the arms 14, 18, a respective distal end 56, 58 of each arm is preferably provided with a flat surface 60. The flat surface 60 is configured to enable the stapler 12 to stand upright on the arms 14, 18, when not in use. Other stapler configurations are contemplated and the present stapler 12 is not deemed limited to the structure described above.

Near the proximal end 22 of the major arm 14, a tape dispenser 62 is preferably located within the arm 14 and is accessible at a first outward side 64. The first outward side 64 of the major arm 14 has a generally convex contour 66, and disposed within the convex contour is a concave contour or chamber 68 in which a tape roll 70 is removably inserted.

A pin 72 inserted through the center of the tape roll 70 maintains the tape roll securely in the major arm 14. The pin is positioned into two opposing holes 74 on two opposing walls 76 in the concave contour 68. Extending from the two opposing holes 74, are two opposing passages 78 which are generally "L"-shaped and form channels on the two opposing walls 76. To remove a depleted tape roll 70 from the tape dispenser 62, the pin 72 is moved within the passage 78 in a first direction, and then moved within the passage in a second direction generally 90-degrees from the first direction. At an outward end 80 of the passage 78, the pin 72 can be removed from the two opposing walls 76, and the tape roll 70 can be replaced.

The tape dispenser 62 also includes a cutting blade 81 disposed at an end 79 of the concave contour 68. The cutting blade 81 is preferably a metal strip with a serrated edge disposed on the main arm 14 and configured to receive and cut tape from the tape roll 70, as is well known in the art. Other configurations of tape cutters are contemplated.

Figure 4:
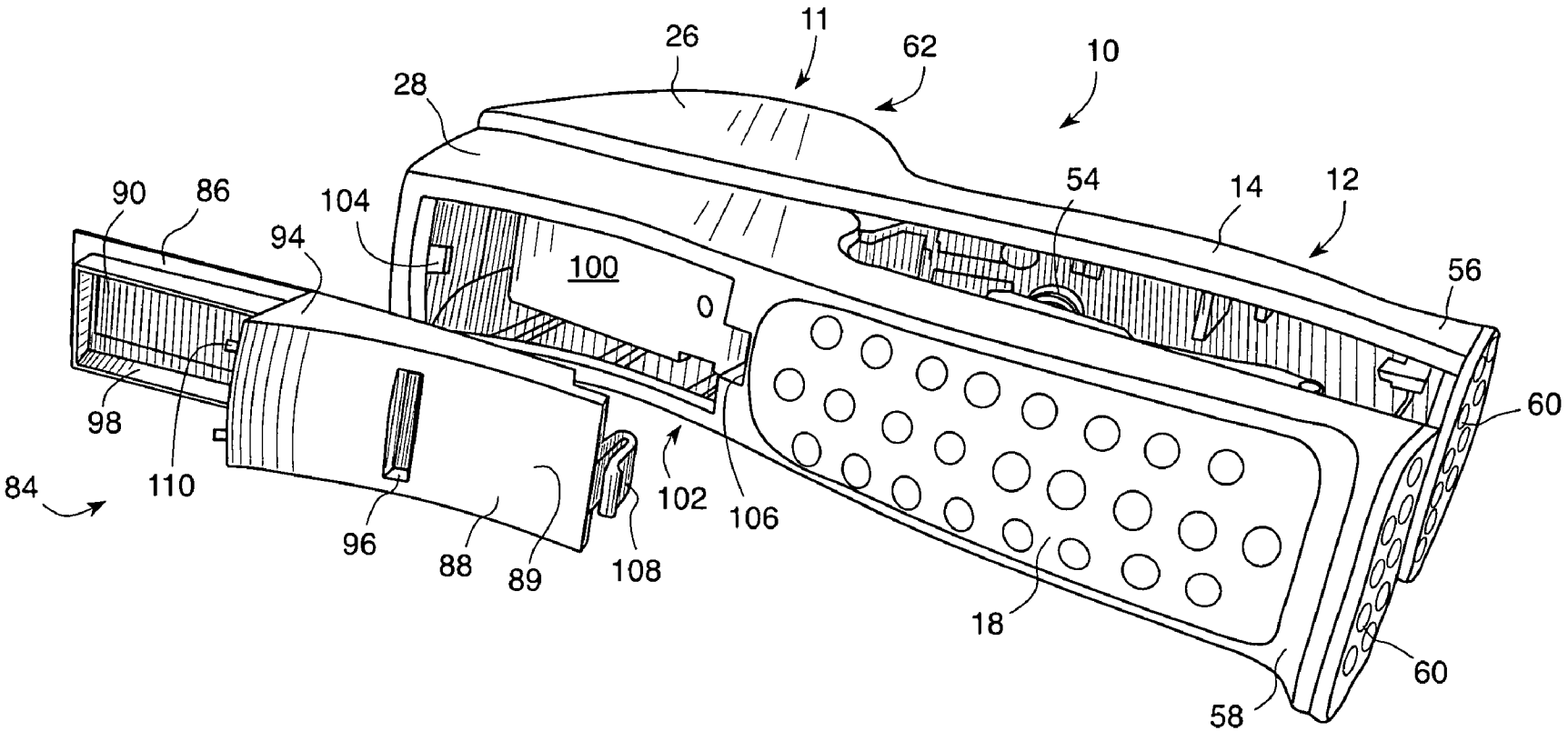
FIG. 4 is an exploded perspective view of the combination stapler of FIG. 1 showing the flag dispenser removed from the stapler.

As seen in FIGS. 3–4, on an outwardly facing surface 82 of the minor arm 18, a flag dispenser 84 is preferably disposed proximate the first end 24. In the preferred embodiment, the flag dispenser 84 has a flag storage bin 86 and a cover 88 which forms a cavity 90 for placement of flags 92. The cover 88 preferably has two arms 94 which generally extend perpendicularly to an exterior surface 89 of the cover 88. A slot 96 is preferably generally centrally disposed on the cover 88 for dispensing the flags 92.

Preferably, the flag storage bin 86 has walls 98 having a size and shape that enables the bin to fit within the arms 94 of the cover 88. Together, the storage bin 86 and the cover 88 are removably placed in a receiving portion 100 of the minor arm 18. Forming a cavity in the minor arm 18, the receiving portion 100 includes a receiving formation 102, such as projections and grooves for receiving and properly locating the cover 88. In the preferred embodiment, the receiving formation 102 is a projection 104 on one end, and a slot 106 on the opposite end.

A resilient tab 108 is preferably disposed on the cover 88 and is configured to engage the slot 106 of the receiving formation 102 to retain the flag dispenser 84 within the minor arm 18. Preferably opposite the tab 108 are two spaced projections 110 configured for engaging the projection 104 between the projections. It is also contemplated that the flag dispenser 84 may be retained in the receiving formation 102 in other ways.

Flags 92 are accessible to the user at the slot 96 where the flags are fed from the storage bin 86 up through the slot. When replacement of the flags 92 is required, the resilient tab 108 is pressed, the slotted cover 88 is removed from the minor arm 18, and the storage bin 86 is removed from the slotted cover for reloading of flags.

In the preferred embodiment, the combination stapler 10 has a smooth, contoured housing assembly, with the tape dispenser 62 and the flag dispenser 84 forming a part of the stapler 12. However, it is contemplated that the combination stapler 10 may be a series of separate housings that are removably attached to the stapler 12, for example, the tape dispenser 62 may be removably attached to the stapler. Further, although the preferred embodiment of the combination stapler 10 includes the tape dispenser 62 and the flag dispenser 84, it is contemplated that additional or substitute office supplies may be incorporated, such as pencil sharpeners, erasers, Post-it® note dispensers, and the like.

While specific embodiments of the present stapler with tape dispenser and flag dispenser have been shown and described, it will be appreciated by those skilled in the art that changes and modifications may be made thereto without departing from the invention in its broader aspects and as set forth in the following claims.

I claim:

1. A combination stapler, tape dispenser and flag dispenser, comprising:

a stapler having a housing including first and second arms each having a length and joined together at a pivot, said first and second arms each including a proximal end and a distal end relative to said pivot, said arms each including an inside-facing surface, said inside-facing surfaces are oriented to face each other, said arms also including an outwardly opposing surface that is opposite said inside-facing surface;

a tape dispenser disposed in said housing adjacent said proximal end of said first arm for dispensing tape; and a flag dispenser disposed in said housing adjacent said proximal end of said second arm for dispensing flags;

wherein said tape dispenser and said flag dispenser are positioned along the length of said first and second arms at said outwardly opposing surfaces for respectively dispensing said tape and flags from said outwardly opposing surfaces.

2. The device of claim 1 further comprising a dispensing mechanism associated with said first arm, said dispensing mechanism configured for dispensing staples.

3. The device of claim 1 wherein said first and second arms are pivotally attached to said pivot allowing said first arm and said second arm to pivot with respect to each other.

4. The device of claim 1 wherein said housing is configured so that said stapler, said tape dispenser and said flag dispenser include refillable expendables associated with at least one of said stapler, said tape dispenser and said flag dispenser.

5. The device of claim 1 further comprising a flat surface at said distal end of each arm configured to permit the device to stand on said flat surfaces.

6. A combination flag dispenser disposed in a stapler for dispensing flags, comprising:

a housing including first and second arms joined together at a pivot, at least one of said first and second arms having an inside-facing surface facing the other of said first and second arms, and an outwardly opposing surface opposite said inside-facing surface;

a storage bin configured to store the flags, wherein said storage bin is located in one of said first and second arms, said storage bin being configured for dispensing flags from outwardly opposing surface; and a cover having a slot for feeding flags through said cover;

wherein said storage bin and said cover are removably disposed in the stapler.

7. The flag dispenser of claim 6 wherein said storage bin and said cover are received in a receiving structure of said stapler.

8. The flag dispenser of claim 7 further comprising a tab on said cover and a receiving formation on said receiving structure, wherein said tab is configured to be received in said receiving structure.

9. The flag dispenser of claim 6 wherein said cover is contoured with an arm of the stapler.

10. The flag dispenser of claim 6 wherein said bin has a plurality of walls for retaining the flags in the bin.

11. The flag dispenser of claim 10 further comprising arms on said cover configured to encapsulate at least two of said plurality of walls of said bin when said cover is placed over said bin.

12. A combination stapler having a housing and a tape dispenser disposed in the housing for dispensing tape, comprising:

a first arm having a proximal end and a distal end;

a second arm having a proximal end and a distal end, said second arm pivotally connected to said first arm at said proximal ends at a pivot, said second arm having a staple magazine member;

two, exposed convex contours extending outwardly with respect to said pivot along a portion of a length of said second arm, and closer to said proximal end than said distal end, said convex contours defining a space located therebetween for receiving a tape roll;

a pin disposed in two opposing, inside walls of said convex contours and configured to be placed through a center of said tape roll;

a concave surface extending inwardly with respect to said pivot on said proximal end of said second arm and said concave surface having a cutting blade; and a first grip enhancing pad disposed on said distal end of said first arm, and a second grip enhancing pad disposed on said distal end of said second arm, wherein the stapler is configured to be gripped by the user at both the first and second grip enhancing pads.

13. The tape dispenser of claim 12 wherein said cutting blade is disposed on said stapler housing and is configured to cut the tape from the tape roll, said blade being disposed adjacent said proximal end.

14. The tape dispenser of claim 12 further comprising a passage on said opposing, inside walls of said convex contour, said passage configured to receive said pin, wherein said passage extends in at least one of a first direction and a second direction.

15. The tape dispenser of claim 14 wherein said first direction is generally perpendicular to said second direction.

16. The tape dispenser of claim 14 further comprising an end of said passage at said convex contour configured to receive said pin in said passage.

* * * * *